US006165606A

United States Patent [19]

Kasahara et al.

[11] Patent Number: 6,165,606

[45] Date of Patent: Dec. 26, 2000

[54] INK JET RECORDING PAPER AND INK JET RECORDING METHOD

[75] Inventors: Kenzo Kasahara; Masaru Tsuchiya; Yoshihiro Mochizuki; Akira Onodera, all of Hino, Japan

[73] Assignee: Konica Corporation, Tokyo, Japan

[21] Appl. No.: 09/017,066

[22] Filed: Feb. 2, 1998

[30] Foreign Application Priority Data

Feb. 6, 1997 [JP] Japan ..... 9-023808

[51] Int. Cl.[7] ..... B41M 5/00

[52] U.S. Cl. ..... 428/323; 428/331; 428/511; 428/513; 428/520; 428/522; 428/537.5

[58] Field of Search ..... 428/323, 331, 428/500, 511, 513, 516, 523, 537.5, 520, 522

[56] References Cited

U.S. PATENT DOCUMENTS

| | | | |
|---|---|---|---|
| 4,830,911 | 5/1989 | Kojima et al. | 428/342 |
| 4,910,084 | 3/1990 | Yamasaki et al. | 428/411.1 |
| 5,002,825 | 3/1991 | Mimura et al. | 428/315.5 |
| 5,165,973 | 11/1992 | Kojima et al. | 428/331 |
| 5,206,071 | 4/1993 | Atherton et al. | 428/195 |
| 5,312,671 | 5/1994 | Atherton et al. | 428/143 |
| 5,418,078 | 5/1995 | Desie et al. | 428/704 |
| 5,612,281 | 3/1997 | Kobayashi et al. | 503/227 |
| 5,856,001 | 1/1999 | Okumura et al. | 428/331 |

*Primary Examiner*—Marie Yamnitzky

*Attorney, Agent, or Firm*—Frishauf, Holtz, Goodman, Langer & Chick, P.C.

[57] ABSTRACT

An ink-jet recording sheet has a recording layer comprising a hydrophilic binder, fine inorganic particles having an average primary particle diameter of 30 nm or less, and a cation type water-soluble mordant having an average molecular weight of 50,000 or less. An ink-jet recording method in which excellent water resistance is provided.

6 Claims, No Drawings

INK JET RECORDING PAPER AND INK JET RECORDING METHOD

FIELD OF THE INVENTION

The present invention relates to an ink-jet recording sheet in which an image is recorded employing an ink comprising a water-soluble dye, and particularly to an ink-jet recording sheet and an ink-jet recording method which exhibit large ink absorbability and high glossiness, and improved water resistance and moisture resistance of a recorded image.

BACKGROUND OF THE INVENTION

Ink-jet recording is carried out by impinging micro-droplets employing various working principles and attaching them onto a recording sheet of paper to record images, letters and the like, and exhibits advantages such as relatively high speed, low noise, easy practice for multicolor, and the like. Regarding this method, conventional problems with clogging of a nozzle and maintenance have been overcome by improvements in both aspects of the ink and instrument, and at present, it has been increasingly employed in various fields such as printers, facsimile machines and computer terminals and the like.

The ink-jet recording sheet employed for the ink-jet recording method has been generally needed to meet requirements such that the density of a printed dot is high and the hue is bright and clear; ink is quickly absorbed and when printed dots are superimposed, ink neither flows nor spreads; diffusion of the printed dot in a horizontal direction is not larger than that required and the border is smooth and causes no unclearness and the like.

As the ink-jet recording sheet, various kinds of ink-jet recording sheets have been employed. For example, there have been employed ordinary paper, various coated paper (art paper, coat paper, cast-coat paper, etc.) prepared by coating a layer comprising a hydrophilic binder and an inorganic pigment on a paper support. Furthermore, there has been employed recording sheets prepared by coating an ink absorptive layer as a recording layer on various supports such as the above-mentioned paper, various kinds of transparent or opaque plastic film supports or various supports prepared by covering both sides of paper with a plastic resin.

The above-mentioned ink absorptive layer is divided into two main groups, that is, one is a so-called swelling-type ink absorptive layer mainly composed of a hydrophilic binder and the other is a void-type ink absorptive layer having a void-containing layer in the recording layer.

The advantages of the swelling type ink absorptive layer is that after an ink solvent (water and high boiling point solvent) is perfectly vaporized, remarkably high glossiness and high density are obtained. On the other hand, the ink-absorbing rate is smaller than that of the void type recording sheet mentioned below,, and there is a problem in which in a high ink density region, image quality is liable to be deteriorated due to the formation of roughness caused by beading and the like. Furthermore, the vaporization of an ink solvent, especially high boiling point organic solvent, is extremely slow and after printing, the high boiling point organic solvent remains in a hydrophilic binder for some time. Thus, there is a problem with the fact that the hydrophilic binder is left under a swelled and wet state for a long period of time.

As a matter of fact, for several hours after printing, in some cases, for several days after printing, the situation is that it is impossible to rub strongly the printed surface or to stack a sheet of paper on it.

On the other hand, the void type ink absorptive layer has voids in the recording layer to result in great ink absorbability. Accordingly, as compared to the swelling type, the image beading hardly occurs in the high ink density area and the degradation of the image quality in the high density area is small.

Furthermore, when the void type ink absorptive layer has a sufficient void volume as compared to that of the ink, the surface immediately after printing works, as if it is dried, even though an organic solvent remains in the void structure. Thus, it would be possible to touch the surface and to bring printed sheets into contact each other.

Because as this type of ink absorptive layer, a relatively high transparent layer is formed, fine particles having a low refractive index (refractive index of 1.6 or less is particularly preferred.) and further a small diameter (200 nm or less is particularly preferred.) are preferably employed. Of particles, fine particle silica which meets such conditions is particularly preferably employed, since it forms efficiently voids, and further, enables to obtain relatively high glossiness and an image having high maximum density.

As conventional techniques in which the above-mentioned inorganic fine particles having a small diameter are employed in the ink-jet recording sheet, colloidal silica is described, for example, in Japanese Patent Publication Open to Public Inspection Nos. 57-14091, 60-219083, 60-219084, 61-20797, 61- 188183, 63-178084, 2-274857, 4-93284, 5-51470, 5-278324, 6-92011, 6-183131, 6-183134, 6-297830, 7-17125, 7-52526, 7-81214, 7-101142, 7-117335, 7-179029, 7-137431, 8-25800, 8-67064, 8-118790; fine silica particles prepared by a gas phase method are described in Japanese Patent Publication No. 3-56552, Japanese Patent Publication Open to Public Inspection Nos. 63-170074, 2-13986, 2-187383, 2-188287, 7-276789, 8-34160, 8-132728, 8-174992, porous alumina or its hydrate described in, for example, Japanese Patent Publication Nos. 3-24906, 3-24907, 6-98844, 7-2430, 7-121609, Japanese Patent Publication Open to Public Inspection Nos. 60-2455882-43083, 2-198889, 2-263683, 2-276671, 3-215081, 3-215082, 3-281383, 3-281384, 3-284978, 4-67985, 4-67986, 4-92813, 4-115984, 4-202011, 4-267179, 4-263981, 4-263982, 4-263983, 4-267180, 4-308786, 4-320877, 4-3230754-345883, 5-16517, 5-24335, 5-24336, 5-32037, 5-32413, 5-32414, 5-50739, 5-124330, 5-301441, 6-55829, 6-183133, 6-183135, 6-183126, 6-199034, 6-199035, 6-255235, 6-262844, 6-270530, 6-297831, 6-183187, 6-48016, 7-76162, 7-89216, 7-89211, 7-76161, 7-108754, 7-125412, 7-164730, 7-172038, 7-232473, 7-232474, 7-232475, 7-237248, 7-246769, 7-276783, 7-290816, 7-304249, 8-2087, 8-2090, 8-2091, 8-2093, 8-25796, 8-72388, 8-90900, 8-108614, 8-112964,8-197832, 8-258397, etc.; fine particulate calcium carbonate described in, for example, Japanese Patent Publication Open to Public Inspection Nos. 57- 120486, 57-129778, 58-55283, 61-20792, 63-57277, 4-250091, 3-251487, 4-250091, 4-260092, 7-40648, etc. and the like.

Of these, when the fine particle silica is employed, the decrease in density of recorded images is smallest and clear color images having a high maximum density is obtained.

The ink-jet recording sheet comprising a support having thereon the above-mentioned void type ink absorptive layer is excellent in resulting in particularly high glossiness, high void ratio and high maximum density. In addition to those, when a support having relatively good flatness is employed, the ink-jet recording sheet having a high glossy surface is obtained. On the other hand, the water-soluble dye is employed. Therefore, there is caused a problem in that when stored at high temperature and humidity for a long period of time after printing or attached with a water droplet, the dye blots.

In order to improve the water resistance and moisture resistance of the dye, heretofore, there have been proposed various methods to fix the dye. A particularly effective method is that an aqueous solution containing uniformly a polymer having a tertiary or quaternary nitrogen atom or its particulate latex is added.

For example, Japanese Patent Publication Open to Public Inspection No. 57-36692 describes an ink-jet recording sheet which is prepared by coating a coating solution comprising a basic mordant and gelatin as one part of a binder as an ink-receiving layer on a support such as paper base or polyethylene terephthalate film.

Japanese Patent Publication Open to Public Inspection No. 53-49113 describes an ink-jet recording sheet for aqueous ink in which polyethyleneimine is impregnated into paper inside.

Japanese Patent Publication Open to Public Inspection No. 58-24492 describes a recording material comprising an electrolyte polymer having a cation or anion group.

Japanese Patent Publication Open to Public Inspection No. 63-224988 describes a recording material in which an ink-receiving layer comprises a primary or tertiary amine, or a quaternary ammonium salt, and the pH of an ink-holding layer ranges from 2 to 8.

Japanese Patent Publication Open to Public Inspection No. 63-307979 describes an ink-jet recording sheet comprising a layer comprising a hydrophilic polymer mordant having a tertiary or quaternary nitrogen atom and a polymer having a hydrophilic group.

Japanese Patent Publication Open to Public Inspection Nos. 59-198186 and 59-198188 describe recording materials in which a polyethyleneimine organic salt is incorporated in a base material or a coating layer on the base material.

Japanese Patent Publication Open to Public Inspection No. 60-46288 describes an ink-jet recording method employing a recording material comprising an ink containing a specified dye, polyamine, etc.

Japanese Patent Publication Open to Public Inspection Nos. 61-61887, 61-72581, 61-252189 and 62-174184 describe ink-jet recording sheets comprising polyacrylamine.

Japanese Patent Publication Open to Public Inspection No. 61-172786 describes an ink-jet recording material comprising a polymer having an intermolecular hydrogen bond (gelatin, polyethyleneimine, etc.) and a polymer having no intermolecular hydrogen bond (polyethylene glycol, polyvinylpyrrolidone, etc.).

Japanese Patent Publication Open to Public Inspection No. 63-162275 describes an ink-jet recording sheet in which a cationic polymer and a cation surface active agent are coated on a support or impregnated into the support.

Japanese Patent Publication Open to Public Inspection No. 6-143798 describes an ink-jet recording sheet in which a dye-fixing layer mainly composed of a quaternary ammonium salt polymer and a cation-modified polyvinyl alcohol is provided on a plastic support and a dye-penetrating/ink absorptive layer is provided thereon.

Furthermore, Japanese Patent Publication Open to Public Inspection Nos. 59-20696, 59-33176, 59-33177, 59-96987, 59-155088, 60-11389, 60-49990, 60-83882, 60-109894, 61-277484, 61-293886, 62-19483, 62-198493, 63-49478, 63-115780, 63-203896, 63-274583, 63-280681, 63-260477, 1-9776, 1-24784, 1-40371, 3-133686, 6-234268, 7-125411, etc. describe that each of specified polymers or compounds comprising a tertiary or quaternary nitrogen atom is added to an ink-receiving layer.

Such techniques to fix a dye described in the prior art exhibit an effect worthwhile fixing the dye. However, there have been a problem caused by employing the cationic polymer.

Namely, when in order to accomplish the high ink absorbability, a large amount of inorganic fine particles is employed on a support, aggregation between the fine particles and the cationic polymer is caused to be liable to form coarse particles. Accordingly, even though a recording layer is formed by coating such coating solution on a support, a problem is caused in that good glossiness is hardly obtained.

Japanese Patent Publication No. 2-188287 describes that an ink-jet recording sheet which exhibits consistent image quality and high recording density, while keeping appearance and touch like paper is prepared by providing on an ink-absorbing support, a layer prepared by mixing dehydrated silica comprised of ultra-fine particles with a cationic polymer.

However, when the technique described in the above-mentioned patent is only employed, aggregate is liable to be formed and high glossiness on a recording layer is hardly obtained. When obtaining the appearance as described in the above-mentioned patent is only set as an object, such technology alone would meet fully the requirements. However, it is not sufficient to obtain high glossiness as exhibited in photographic prints and the like.

SUMMARY OF THE INVENTION

An object of the present invention is to provide an ink-jet recording sheet and an ink-jet recording method in which excellent water resistance is obtained by adding a cationic mordant to a void-containing layer of a recording sheet comprising a support having thereon the void-containing layer comprising inorganic fine particles as a recording layer and no decrease in glossiness is accomplished by avoiding aggregate formation between inorganic fine particles and a cationic polymer.

An ink-jet recording sheet of the invention and its embodiment are described.

An ink-jet recording sheet comprising a support having thereon at least one recording layer comprising a hydrophilic binder, inorganic fine particles having an average diameter of primary particle of 30 nm or less and a water-soluble cation type mordant having an average molecular weight of 50,000 or less.

At least one part of the inorganic fine particles is preferably fine particle silica prepared by a gas phase method.

The binder is preferably polyvinyl alcohol or its derivative.

The recording layer preferably comprises a hardening agent which is capable of cross-linking with a hydrophilic binder.

The water-soluble cation type mordant is preferably a compound represented by the general formula (1) described below.

General formula (1)

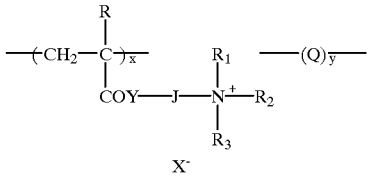

wherein R represents a hydrogen atom or an alkyl group having from 1 to 4 carbon atoms and $R_1$, $R_2$ and $R_3$ each independently represents an alkyl group having from 1 to 4 carbon atoms. Y represents an oxygen atom or a —N($R_4$)— group ($R_4$ represents a hydrogen atom or an alkyl group.) and J represents a divalent linking group. X represents an anion. Q represents a recurrence unit derived from a monomer having an ethylenic unsaturated group and no cationic group. However, the value (inorganic/organic) of the monomer constructing Q is not less than 0.5. Furthermore, Q includes the case of copolymerization of two kinds or more of monomers. X ranges 4 from 30 to 100 mole percent and Y ranges from 0 to 70 mole percent (however, X+Y=100 mole percent).

The support is preferably a paper support in which both the sides are covered with a polyolefin resin.

The present invention is explained in detail below.

As a support used for the ink-jet recording sheet of the invention, paper supports such as plain paper, art paper, coat paper and cast coat paper are used, and a plastic film support, a paper support which is coated on its both sides with polyolefin, and a compound support which is made by sticking some of those mentioned above together are also used. Among the foregoing, a plastic film support and a paper support which is coated on its both sides with polyolefin are preferable from a viewpoint of a property of high gloss, in which the paper support coated on its both sides with polyolefin is especially preferable.

A preferable plastic film support includes those of plastic resins such as, for example, polyethylene, polypropylene, polystyrene, polyethylene terephthalate, polyethylene naphthalate, triacetyl cellulose, polyvinylchloride, polyimide, polycarbonate and cellophane.

These plastic film supports including transparent, translucent and opaque ones can be used properly on a right one for right application basis.

In the case of a white film, a support obtained by causing it to contain a small amount of white pigments such as barium sulfate, titanium oxide or zinc oxide can be used as it is, or there can be used a support provided with a layer containing white pigments (titanium oxide or barium sulfate) on the reverse side of a transparent film support or on the side of an ink absorptive layer closer to the support.

Next, the paper support coated on its both sides with polyolefin which is used preferably in particular will further be explained in detail.

A raw paper used for a paper support contains wood pulp as primary raw material, and it is manufactured by the use of synthetic pulp of polypropylene or synthetic fiber of nylon or of polyester, in addition to wood pulp in case of need. Wood pulp capable of being used includes LBKP, LBSP, NBKP, NBSP, LDP, NDP, LUKP and NUKP, and it is preferable to use more LBKP, NBSP, LBSP, NDP and LDP each containing more short fiber. However, it is preferable that a percentage of LBSP and LDP or a percentage of LBSP or that of LDP is 10 wt %–70 wt %.

Chemical pulp having less impurities (sulfate pulp and sulfite pulp) is preferably used as the above-mentioned pulp, while, another pulp which is subjected to bleaching to improve whiteness is also useful.

It is possible to add properly to the raw paper sizing agents such as higher fatty acid and alkyl ketene dimer, white pigments such as calcium carbonate, talc and titanium oxide, paper strength reinforcing agents such as starch, polyacrylamide and polyvinyl alcohol, moisture retention agents such as fluorescent brightening agents and polyethylene glycol, and softening agents such as quaternary ammonium.

It is preferable that the freeness of pulp to be used for manufacturing paper is 200–500 cc in CSF standard, and it is preferable that a fiber length after beating shows the sum of 24 mesh residue wt % and 42 mesh residue wt % stipulated in JIS-P-8207 representing 30%–70%. It is preferable that a percent by weight of 4 mesh residue is not more than 20 wt %.

Weight of a raw paper is 60–250 g preferably, and is 90–200 g preferably in particular. A thickness of a raw paper which is 50–250 $\mu$m is preferable.

It is also possible to make a raw paper to be highly smooth by treating it with a calender in the course of paper making or after paper making. It is normal that density of a raw paper is 0.7–1.2 g/$m^2$ (JIS-P-8118). Further, it is preferable that stiffness of a raw paper is 20–200 g under the condition stipulated in JIS-P-8143.

A raw paper may also be coated on its surface with surface sizing agents which can be the same as the above-mentioned sizing agents which can be added to the raw paper.

It is preferable that pH of a raw paper is 5–9, when it is measured through a hot water extracting method stipulated in JIS-P-8113.

As polyolefin by which the surface and the back of a raw paper are coated, polyethylene is especially preferable and it mainly includes low density polyethylene (LDPE) and/or high density polyethylene (HDPE). However, other LLDPE (line-shaped low density polyethylene) and polypropylene may also be used partially.

In particular, a preferable polyethylene layer positioned on the ink-accepting layer side is one wherein titanium oxide of a rutile-type or of an anatase-type is added in polyethylene to improve opacity and whiteness as is commonly implemented in a photographic paper. Titanium oxide content in polyethylene is 3–20 wt % normally, and is 5–15 wt % preferably.

A layer thickness on the surface of a raw paper and that on the back of a raw paper are selected after providing an ink-accepting layer and a backing layer so that curling under the conditions of low humidity and high humidity may be optimum, in which a thickness of a polyethylene layer on the ink-accepting layer side is usually 20–50 $\mu$m and that on the backing layer side is 10–40 $\mu$m.

It is further preferable that a paper support coated with polyethylene has the following characteristics.

(1) Tensile strength: It is preferable that the tensile strength in the longitudinal direction is 2–30 Kg and that in the lateral direction is 1–20 Kg when they are represented by strength stipulated in JIS-P-8113.

(2) Tear strength: It is preferable that the tear strength in the longitudinal direction is 10–300 g and that in the lateral direction is 20–400 g when they are obtained through a method stipulated in JIS-P-8116.

(3) Clark stiffness: Clark stiffness of 20–400 g/100 is preferable.

(4) Compression elastic modulus $\geqq 10^3$ Kgf/cm$^2$.

(5) Surface smoothness: Smoothness stipulated in JIS-P-8119 is 500 sec or more, and it preferably is 1000 sec or more in particular.

(6) Surface roughness: When the maximum wave swelling is measured, using the standard length of 2.5 mm, on the wave-swelling curve derived, under the condition of a cutoff value represented by 0.8 mm, from a section curve obtained through a method stipulated in JIS-B-0610, it is preferable that the number of points where the maximum swelling is 6 $\mu$m or more is not more than 5 in arbitrary 100 measurement points, and an average roughness for 10 points is not more than 4 $\mu$m.

(7) Surface glossiness: When the surface glossiness is measured at an angle of 75° in the method stipulated in JISZ-8741, the surface glossiness is 30% or more, and 70% or more is preferable, while 90% or more is especially preferable.

(8) Surface whiteness: When measured in the method described in JIS-Z-8722 and indicated in accordance with JIS-Z-8729, L* is 85% or more, and 90% or more in particular is preferable. With regard to (a*, b*), a color tone within a range surrounded by (−2, 2), (4, 2), (4, −8) and (−3, −8) is preferable.

(9) Opacity: When measured in a method stipulated in JIS-P-8138, the opacity is 50% or more, and it preferably is 90% or more, and the most preferable is 94% or more.

For the purpose to increase the adhesion strength between a support and a recording layer, it is preferable that the support is subjected to corona discharge processing and subbing processing prior to coating of the recording layer.

In the invention, a support is provided thereon with at least one recording layer containing therein hydrophilic binders, inorganic fine particles and water-soluble mordants of a cation type.

As an inorganic fine particle, an inorganic fine particle having a low index of refraction and there are given, for example, a small particle size is preferable, and silica, colloidal silica, calcium silicate, calcium carbonate, boehmite aluminum or its hydrate, out of which silica is preferable.

Silica fine particles are classified in terms of manufacturing method into those made through a dry method and those made through a wet method. As fine particle silica made by a dry method, there are known those made through hydrolysis in a gas phase method of silicon halogenide at high temperature and those obtained by heating, reducing and evaporating siliceous sand and coke in an electric furnace through an arc method and by air-oxidizing them. On the other hand, silica made by a wet method is obtained by generating active silica through acid decomposition of silicate and then by polymerizing it properly for aggregation and precipitation.

In the invention, fine particle silica synthesized through a gas phase method, in particular, is preferable among silica fine particles, on the point that voidage which is especially high, high film strength and high glossiness are obtained.

With regard to an average particle size of inorganic fine particles, particles having an average particle size of not more than 30 nm as primary particles are used. When particles having an average particle size exceeding 30 nm as primary particles are used, they tend to aggregate with water-soluble polymer mordants of a cation type, and aggregated particles in that case are coarse particles, and glossiness is lowered accordingly. An average particle size of primary particles which is especially preferable is not more than 20 nm.

The lowest value of an average particle size of primary particles is not limited in particular, it is normally 3 nm or more, and the preferable is 6 nm or more from a viewpoint of manufacture of particles.

An average particle size of inorganic fine particles is obtained as a simple average value (the number average) of particle sizes of arbitrary 100 particles which are obtained by observing particles themselves or sections or surfaces of void-containing layers. In this case, an individual particle size of a particle is represented by a diameter of an assumed circle which is the same in terms of area as a projected area of the particle.

In the ink-jet recording paper of the invention, it is also possible to use jointly inorganic fine particles whose primary particles have an average particle size of 30 nm or less and inorganic fine particles whose primary particles have an average particle size exceeding 30 nm. In this case, it is preferable that the ratio of inorganic fine particles having an average particle size exceeding 30 nm to the total inorganic fine particles is 50 wt % or less, and the more preferable is 20 wt % or less.

For water-soluble polymer dye mordant of a cation type used for the ink-jet recording paper of the invention, a polymer which is water-soluble and has an average molecular weight of 50000 or less among mordants known in conventional ink-jet recording papers is used.

In this case, what is meant by water-soluble mordant is that the mordant is water-soluble under the condition that latex-shaped particles like those obtained when polymer mordant is synthesized through an emulsion polymerization method are not formed, and preferable mordant is one synthesized through a solution polymerization method.

Water-solubility includes, in addition to those which are soluble in water, a polymer soluble in a mixed solvent containing water and water-miscible organic solvent such as methanol, isopropyl alcohol, acetone and ethyl acetate. In this case, with regard to an amount of water-miscible organic solvent, a solvent wherein a ratio of the water-miscible organic solvent to the total solvent is usually 50 wt % or less is used.

When a mordant is said to be water-soluble, it means that polymer in the mordant normally shows solubility in solvent of 1 wt % or more at room temperature.

It is necessary that an average molecular weight of water-soluble mordant of a cation type is 50000 or less. When a mordant having molecular weight exceeding 50000 is used, aggregation with inorganic fine particles tends to be caused, resulting in lowered glossiness on a recording layer. A mordant having an average molecular weight of 30000 or less is preferably used.

Though a lower limit of an average molecular weight is not restricted from a viewpoint of prevention of aggregation of a coating solution, a mordant having an average molecular weight of not less than 2000, preferably of not less than 5000 is used from a viewpoint of moisture resistance and water resistance.

The average molecular weight of the water-soluble polymer mordant mentioned above means number average molecular weight shown after completion of polymerization, and it means a value converted to polystyrene which is obtained from a gel permeation chromatography.

As a water-soluble mordant of a cation type, those selected appropriately from known mordants can be used as stated above. These mordants represent a polymer having a repeating unit which has at least one quaternary ammonium base in its molecular structure. Among mordants of such polymer, a polymer mordant represented by the above-mentioned Formula (1) is especially preferable due to the reasons that prevention of aggregation with inorganic fine particles is small, deterioration of light resistance is small, and an adverse effect such as aging coloring is less.

In Formula (1), R represents a hydrogen atom or an alkyl group having 1–4 carbon atoms, and the preferable represents a hydrogen atom and a methyl group.

Each of $R_1$, $R_2$ and $R_3$ represents independently an alkyl group having 1–4 carbon atoms, and they may also be substituted with a hydroxyl group, a carbamoyl group, a sulfoamide group and a halogen atom. The preferable is the case where $R_1$, $R_2$ and $R_3$ respectively represent a methyl group.

Y represents an oxygen atom or —N($R_4$)— group ($R_4$ represents a hydrogen atom or an alkyl group), and the preferable is an oxygen atom.

J represents a divalent linking group, and the preferable is —$(CH_2)_n$— (n represents integers of 1–4).

$X^-$ represents an anion, and examples thereof include, for example, a halogen ion (chlorine ion, bromine ion, iodine ion), a sulfate ion, an alkyl sulfate ion (for example, methyl sulfate ion, ethyl sulfate ion etc.), an arylsulfonic acid ion (for example, p-toluene sulfonic acid ion and others) an acetic acid ion. The symbol x represents 30–100 mol % and y represents 0–70 mol % (x+y=100 mol %).

Two or more kinds of monomers each containing a cation group represented by Formula (1) can be subjected to copolymerization.

Q represents a repeating unit derived from a monomer which has an ethylenic unsaturated group and has no cationic group, and an inorganic/organic ratio of the monomer constituting Q is not less than 0.5. The inorganic/organic ratio in this case is a parameter showing a ratio of inorganic property to organic property in organic compounds, and its details are described on pages 1–31 in YUKI GAINENZU-KISO TO OHYO—(The base and application of organic conceptual diagram) (written by Yoshio Koda, published on May 10, 1984 by Sankyo Publishing Co.).

When the ratio of inorganic property to organic property is great, the rate of inorganic property of a compound is increased, while when the ratio of inorganic property to organic property is lowered, the rate of inorganic property is lowered. In the invention, however, those having a great ratio of inorganic property to organic property as Q are preferable because of less aggregation with inorganic fine particles. The preferable ratio of inorganic property to organic property of a monomer constituting Q is 0.5–3, and the most preferable is 0.5–2.5.

It is preferable that a monomer constituting Q does not contain an anionic dissociative group such as a carboxyl group or a sulfo group in its molecular structure.

Monomers constituting Q may be polymerized by using two or more kinds thereof in combination, and even in this case, it is preferable that each of them satisfies the conditions which are to be satisfied by Q.

Examples of a monomer forming a repeating unit represented by Q mentioned above are shown below.

Q-1

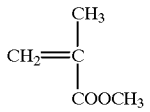

(I/O = 0.87)

Q-2

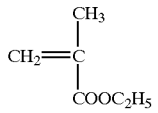

(I/O = 0.725)

Q-3

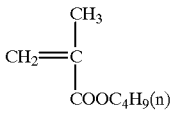

(I/O = 0.544)

Q-4

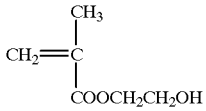

(I/O = 1.558)

Q-5

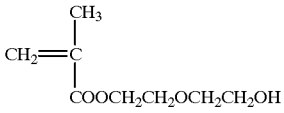

(I/O = 1.294)

Q-6

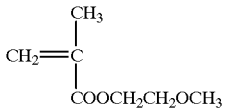

(I/O = 0.764)

Q-7

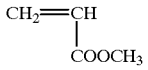

(I/O = 1.088)

Q-8

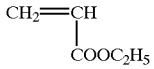

(I/O = 0.87)

-continued
Q-9
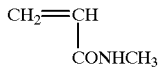
(I/O = 2.525)
Q-10
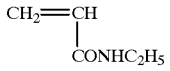
(I/O = 2.02)
-continued
Q-11
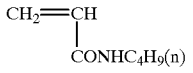
(I/O = 1.44)
Further, the ratio of (inorganic/organic) is represented by (I/O).
Specific examples of the polymer mordants represented by the general formula (1) preferably employed in the present invention are illustrated below. The present invention is, however, not limited to those examples.
Mor-1
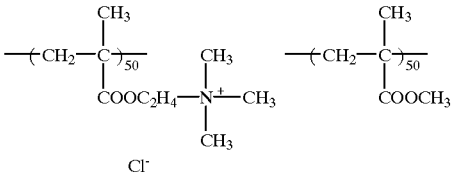
Mor-2
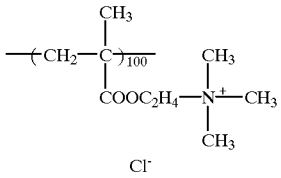
Mor-3
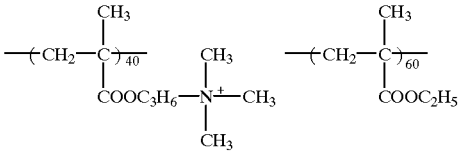
Mor-4
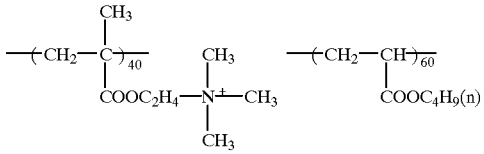
Mor-5
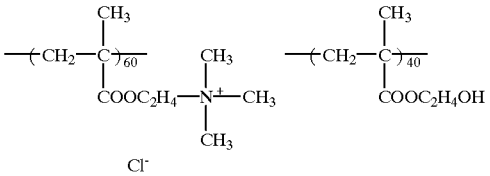
Mor-6
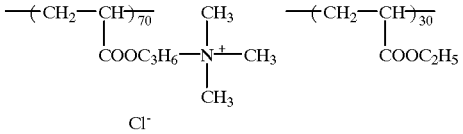
Mor-7
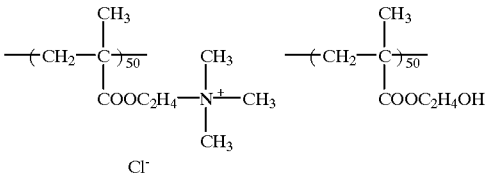
Mor-8
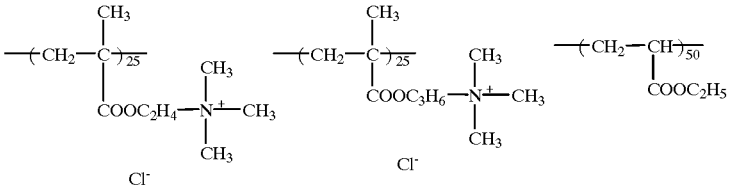
Mor-9
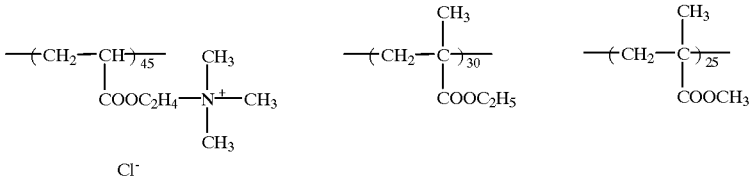

-continued

Mor-10

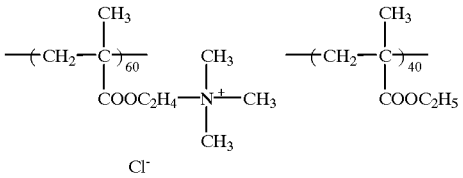

Mor-11

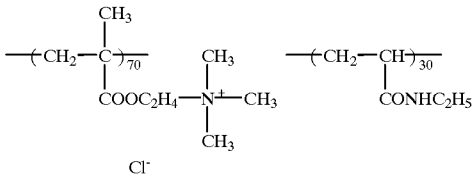

Mor-12

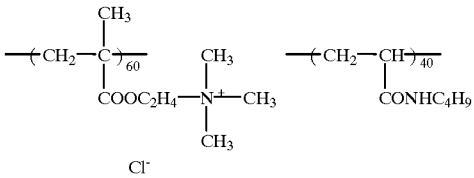

Mor-13

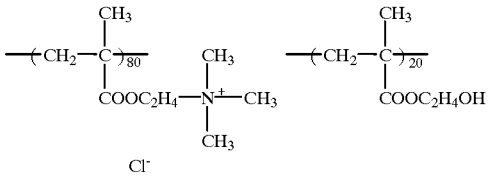

In order to obtain good film forming properties, the ink-jet recording sheet comprises a recording layer comprising a hydrophilic binder, inorganic fine particles and a water-soluble cationic polymer mordant.

As hydrophilic binders, there may be employed polyvinyl alcohol and its derivatives, polyalkylene oxides, polyvinylpyrrolidone, polyacrylamides, gelatin, hydroxyethylcellulose, carboxymethylcellulose, prulan, casein, dextran, etc. Of those, the polyvinyl alcohol or its derivatives are particularly preferred. Of these, the polyvinyl alcohol or its derivatives having an average degree of polymerization of 1,000 or more, and particularly 2,000 or more, are preferably employed. Furthermore, the degree of saponification ranges preferably from 70 to 100 percent, and most preferably ranges from 80 to 100 percent.

Two or more kinds of hydrophilic binders can be employed in combination. Even in this case, it is preferred that at least 50 weight percent or more of the polyvinyl alcohol or its derivative is incorporated in the mixture.

The polyvinyl alcohol derivatives include cation-modified polyvinyl alcohol, anion-modified polyvinyl alcohol or nonion-modified polyvinyl alcohol.

The cation-modified polyvinyl alcohol can be prepared by saponifying a copolymer of an ethylenic unsaturated monomer having a cationic group with vinyl acetate.

The ethylenic unsaturated monomers having the cationic group include, for example, trimethyl-(2-acrylamide-2,2-dimethylethyl)ammonium chloride, trimethyl-(3-acrylamide-3,3-dimethylpropyl)ammonium chloride, N-vinylimdazole, N-vinyl-2-methylimidazole, N-(3-dimethylaminopropyl)methacrylamide, hydroxylethyltrimethylammonium chloride, trimethyl(methacrylamidopropyl) ammonium chloride, N-(1,1-dimethyl-3-dimethylaminopropyl)acrylamide, and the like.

The ratio of the monomer comprising the cation-modified group in the cation-modified polyvinyl alcohol ranges preferably from 0.1 to 10 mole percent of vinyl acetate, and more preferably from 0.2 to 5 mole percent of vinyl acetate.

The degree of polymerization of the cation-modified polyvinyl alcohol ranges generally from 500 to 4,000 and preferably is between 1,000 and 4,000.

Furthermore, the degree of saponification of the vinyl acetate group ranges generally from 60 to 100 mole percent and preferably from 70 to 99 mole percent.

The anion-modified polyvinyl alcohol includes, for example, polyvinyl alcohol comprising an anionic group such as described in Japanese Patent Publication Open to Public Inspection No. 1-206088, copolymers of vinyl alcohol with a vinyl compound having a water-soluble group as described in Japanese Patent Publication Open to Public Inspection No. 63-307979, and modified polyvinyl alcohol having a water-soluble group as described in Japanese Patent Publication Open to Public Inspection No. 7-285265.

The nonion-modified polyvinyl alcohol includes, for example, polyvinyl derivatives in which a polyalkylene oxide group is added to a part of the polyvinyl alcohol as described in Japanese Patent Publication Open to Public Inspection No. 7-9758 and block copolymers of a vinyl compound having a hydrophobic group with vinyl alcohol described in Japanese Patent Publication Open to Public Inspection No. 8-25795.

In a recording layer comprising the hydrophilic binder, inorganic fine particles and cation type water-soluble polymer mordant, the added amount of each is shown below.

It is necessary for a layer comprising fine inorganic particles to have a high ink-absorbing rate and a sufficient ink-absorbing capacity. Accordingly, the layer has preferably voids. In order to form such voids, the amount of the fine inorganic particles is preferably two or more times the total amount of the water-soluble polymer mordant and hydrophilic binder, and more preferably three or more times, and most preferably four or more times. When the amount of the fine inorganic particles is small, the ratio of the formation of the void decreases and subsequently, the ink-absorbing rate also decreases.

The upper limit of the added amount of the fine inorganic particles is dependent on the film-forming properties of the film and the amount varies according to the dried thickness, the hydrophilic binder, the water-soluble polymer mordant, and further kinds of inorganic fine particles. The ratio of the fine inorganic particles is generally at least 20 times the total of the hydrophilic binder and water-soluble polymer mordant in terms of weight ratio, and more preferably 15 times or less.

Furthermore, the ratio of the above-mentioned hydrophilic binder to the water-soluble polymer mordant is generally in the range of from 0.2 to 10 by weight.

The thickness of the inorganic particle-containing layer varies according to the required volume of the voids or the void ratio of the layer and generally ranges from about 20 to about 50 $\mu$m as the dry thickness. The volume of the void also ranges generally from 10 to 35 ml per $m^2$ of the ink-jet recording sheet.

The volume of the void is expressed in liquid transfer volume ($ml/m^2$) two-second absorption time when the ink-absorbing side of the recording sheet is measured by the methods described in the J. TAPPI Paper and Pulp Test Method Nos. 51 to 87 and the Liquid Absorbing Test Method for the Paper and Paperboard (Bristow Method). Further, the liquid to be used is pure water (deionized water). However, it may contain less than 2 percent of a water-soluble dye in order to facilitate identification of the area to be measured.

To the above-mentioned void-containing layer of the ink-jet recording sheet, a hardening agent, cross-linkable with the above-mentioned hydrophilic binder, is preferably added so as to improve the film forming properties of the void-containing layer, the water-resisting properties, and the film strength after printing, which is the object of the present invention.

Such hardening agents include organic hardening agents comprising an epoxy group, an ethyleneimino group, an active vinyl group, etc., and inorganic hardening agents such as chromium alum, boric acid, borax, etc.

When the hydrophilic binder is a polyvinyl alcohol, epoxy series hardening agents having at least two expoxy groups in the molecule, boric acid or its salts and borax are particularly preferred. As the boric acid, besides the boric acid itself, metaboric acid, hypoboric acid, etc. may be employed.

The added amount of the hardening agent ranges preferably from 1 to 200 mg, and more preferably from 2 to 100 mg, per g of the above-mentioned hydrophilic binder.

In an optional layer of the ink-receiving layer side of the ink-jet recording sheet, various additives can if desired be added.

For example, it is possible to add various additives, known in the art, such as UV absorbers described in Japanese Patent Publication Open to Public Inspection Nos. 57-74193, 57-87988 and 2-261476, antifading agents described in Japanese Patent Publication Open to Public Inspection Nos. 57-74192, 57-87989, 60-72785, 61-146591, 1-95091, 3-13376, etc., various anion, cation or nonion surface active agents, fluorescent whitening agents described in Japanese Patent Publication Open to Public Inspection Nos. 59-42993, 59-52689, 62-280069, 61-242871, 4-219266, etc., pH-adjusting agents such as sulfuric acid, phosphoric acid, acetic acid, citric acid, sodium hydroxide, potassium hydroxide, potassium carbonate, etc., antifoaming agents, lubricants such as diethylene glycol, etc., antiseptics, thickeners, antistatic agents, matting agents, etc.

The ink-jet recording sheet may have two or more recording layers, each having a void-containing layer. In this case, the ratios of the fine inorganic particles in two or more of the void-containing layers to the hydrophilic binder may be different from each other.

Except for the void-containing layer, it may have a layer capable of being swelled by ink or a swelling layer without having the void-containing layer.

Such a swelling layer may be provided under the void-containing layer (the side near support) or on the void-containing layer (away from the support). Furthermore, when there are two or more of the void-containing layers, the swelling layer may also be provided between the void-containing layers. In such a swelling layer, a hydrophilic binder is generally employed. The binders employed in the layer include, for example, hydrophilic binders employed for the above-mentioned void-containing layer.

On the reverse of the ink-absorbing side of the ink-jet recording sheet, various kinds of backing layers are preferably provided in order to prevent curl and sticking when stacked soon after printing and improve further the transfer of ink.

The construction of the backing layer varies according to the kind and thickness of the support and the construction and thickness of the ink absorptive layer. Generally, a hydrophilic binder or a hydrophobic binder is employed. The thickness of the backing layer is generally in the range of from 1 to 10 $\mu$m.

A roughened surface can be provided on the backing layer in order to prevent sticking to the other ink-jet recording sheets, to improve writability and to enhance transportability in an ink-jet recording apparatus. Fine organic or inorganic particles having a particle diameter of 2 to 20 $\mu$m are preferably employed for this purpose.

An aqueous ink employed for the ink-jet recording sheet is explained below.

The aqueous ink is an ink-jet recording liquid composed generally of a water-soluble dye, a liquid medium and other additives. As water-soluble dyes, there can be employed water-soluble dyes such as direct dyes, acid dyes, basic dyes, reactive dyes for ink-jet or food dyes. Of those, the direct or acid dyes are preferred.

The solvent of the aqueous ink consists mainly of water. However, in order to prevent clogging at the outlet of a nozzle or in an ink-supplying path due to dye deposit caused by drying, there is usually employed a high boiling point organic solvent which has a boiling point of at least 120° C. and which remains in a liquid state at room temperature. The high boiling point organic solvent is required to have a much lower vapor pressure than that of water in order to exhibit the function of preventing the formation of coarse deposits formed by the deposition of solid components, such as dye when water is vaporized. On the other hand, the solvent requires high compatibility with water.

With such the object, as the high boiling point solvent, organic solvents having a high boiling point are generally employed in most cases. Specific examples include a series of alcohols such as ethylene glycol, propylene glycol, diethylene glycol, triethylene glycol, glycerin, diethylene glycol monomethyl ether, diethylene glycol monobutyl ether, triethylene glycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, polyethylene glycol (with an average molecular weight of 300 or less). Besides these, dimethylformamide, N-methylpyrrolidone, etc. can be employed.

Of these high boiling point organic solvents, those preferred include polyhydric alcohols such as diethylene glycol, triethanolamine, glycerin, etc., and lower alkyl ethers of polyhydric alcohol such as triethylene glycol monobutyl ether.

Other additives incorporated in the aqueous ink include, for example, pH-adjusting agents, metal-blocking agents, mildewcides, viscosity-adjusting agents, surface tension-adjusting agents, wetting agents, surface active agents, anti-rusting agents, etc.

With the object for improving the wettability of the aqueous ink on the ink-jet recording sheet and stabilizing the discharge from a ink-jet nozzle, the aqueous ink should be provided with a surface tension at 25° C. in the range of 25 to 50 dyne/cm and preferably in the range of 28 to 40 dyne/cm.

The viscosity of the aqueous ink should range, at 25° C., generally from 2 to 8 cp and preferably from 2.5 to 5 cp.

The pH of the aqueous ink ranges generally from 4 to 10.

As a minimum ink droplet discharged from the ink nozzle, in the case of a volume between $1\times10^{-3}$ and $30\times10^{-3}$ ml, a minimum dot diameter of about 20 to about 60 $\mu$m is preferably obtained on the ink-jet recording sheet. A color print printed with such dot diameters results in a high quality image. The preferred case is one of a droplet having a volume between $2\times10^{-3}$ and $20\times10^{-3}$ ml is discharged as a minimum droplet.

With the aqueous ink, at least for magenta and cyan, in a method in which recording is performed with two kinds of inks and each concentration of inks is 10 times or more different, because a low concentration ink is employed at a highlight part, it becomes difficult to identify a dot. However, the present invention can be applied to the case in which such the method mentioned above is employed.

In an ink-jet recording system, as a recording method, various methods conventionally known in the art can be employed. The details are described in "Ink-jet Kiroku Gijutsu Doko (Trend of Ink-jet Recording Technology), Edited Koichi Nakamura, Mar. 31, 1995, Published by Nihon Kagaku Joho Co.".

A method to increase three or more times the volume of the void compared to the volume of a high boiling point organic solvent at the maximum ink flow amount is selected from those under optimum in which the following methods are suitably combined; a decrease in the ratio of the high boiling point solvent in the ink, a decrease in an ink amount at the maximum discharge to be as little as possible or an increase in the layer thickness of the void volume of a recording sheet to be as large as possible.

EXAMPLES

The present invention is explained below with reference to Examples.

Example 1

A paper support which was prepared by covering both sides of a photographic base paper of 160 g/m$^2$ with polyethylene (13 weight percent of anatase titanium dioxide was incorporated in the polyethylene layer having a thickness of 40 $\mu$m on the recording side. The thickness of a polyethylene layer on the back side was 25 $\mu$m, On the polyethylene layer, there was provided a backing layer comprising 0.6 g/m$^2$ of an acrylic series latex resin having a Tg=65° C. as solid material, and 0.3 g/m$^2$ of silica as a matting agent having an average particle diameter of about 13 $\mu$m) was prepared.

Next, 150 g of primary particle silica powder having an average particle diameter of about 7 nm was added to 1,000 ml of pure water and dispersed in a high speed homogenizer to obtain a slightly clouded dispersion. Thereafter, to the aqueous silica dispersion (I), 1,000 ml of 1.6% aqueous polyvinyl alcohol solution (II) (containing six weight percent of ethyl acetate) in which the polyvinyl alcohol had an average degree of polymerization of 3,500 and a degree of saponification of 88 percent was slowly added. As a hardening agent, 40 ml of 4% aqueous borax solution was then added. Thereafter, various kinds of mordants shown in Table 1 were added so that the solid component of the mordant reached 25 weight percent of the polyvinyl alcohol. Each of the resulting liquids was dispersed employing a high speed homogenizer, and thereby a translucent white coating liquid was obtained.

Next, the coating solution at 40° C., prepared as mentioned above, was coated on the recording side surface of the above-mentioned polyethylene-laminated paper and was once cooled (for 20 seconds) so that the temperature of the coated layer was lowered to at least 15° C. Thereafter, the resulting coating was dried by blowing air at 20° C. for 30 seconds, air at 25° C. for 30 seconds, air at 35° C. for 60 seconds, further air at 45° C. for 120 seconds. Further, the water content was adjusted by passing the coating through an atmosphere adjusted to 25° C. and 50% relative humidity for 30 seconds, and thus the ink-jet recording sheets shown in Table 1 were prepared.

The prepared ink-jet recording sheets were evaluated under the criteria listed below.

(1) Void Volume

A Bristow Test Machine Type II (compression type) manufactured by Kumagai Riki Kogyo Co., Ltd. was employed, by which a transfer amount (ml/m$^2$) during contact time of 2 seconds was obtained as a void volume.

(2) Ink Absorbability

The machine employed for measuring the void volume was also used for this evaluation in which the ink absorbability was obtained from the transfer amount (ml/m$^2$) during a contact time of 0.5 second.

(3) Glossiness

The specular gloss at 75° was measured employing a Variable Angle Photometer (VGS-101DP) manufactured by Nihon Denshoku Kogyo Co., Ltd.

(4) Water Resistance

Each of the above-mentioned ink-jet recording sheets was printed by an Ink-jet Printer Deskjet 850C, manufactured by Hewlett Packard Co., Ltd., in such a way that the reflection density of printed single magenta color was about 1.0. After printing, the printed sample was immersed in pure water at room temperature for 12 hours, and the density was measured again. The dye ratio of the density before the water immersion to that after the water immersion was termed the water resistance.

(5) Light Fastness

The sample prepared for the above-mentioned (4) was exposed by a Xenon Fademeter for 100 hours and the reflection density was measured. The residual dye ratio to the initial density was thus obtained.

Table 1 shows these results.

TABLE 1

| Ink-jet Recording Sheet | Mordant Composition | Mordant Average Molecular Weight | Void Volume | Ink Absorbability | Glossiness (%) | Water Resistance (%) | Light Fastness (%) |
|---|---|---|---|---|---|---|---|
| -1 (Comparative Example) | no addition | — | 23 | 13 | 61 | 0 | 72 |
| -2 (Present Invention) | Mor-9 | 3,000 | 22 | 13 | 61 | 61 | 68 |
| -3 (Present Invention) | Mor-9 | 6,000 | 22 | 12 | 60 | 92 | 67 |

TABLE 1-continued

| Ink-jet Recording Sheet | Mordant Composition | Mordant Average Molecular Weight | Void Volume | Ink Absorbability | Glossiness (%) | Water Resistance (%) | Light Fastness (%) |
|---|---|---|---|---|---|---|---|
| −4 (Present Invention) | Mor-9 | 20,000 | 22 | 11 | 58 | 96 | 66 |
| −5 (Present Invention) | Mor-9 | 40,000 | 21 | 12 | 56 | 98 | 67 |
| −6 (Comparative Example) | Mor-9 | 80,000 | 22 | 11 | 40 | 98 | 66 |
| −7 (Present Invention) | Mor-3 | 4,000 | 22 | 12 | 61 | 82 | 62 |
| −8 (Present Invention) | Mor-3 | 8,000 | 22 | 12 | 61 | 95 | 61 |
| −9 (Present Invention) | Mor-3 | 16,000 | 21 | 11 | 60 | 98 | 62 |
| −10 (Present Invention) | Mor-3 | 42,000 | 21 | 11 | 57 | 98 | 63 |
| −11 (Comparative Example) | Mor-3 | 110,000 | 21 | 11 | 31 | 98 | 62 |

Based on the results in Table 1, it can be seen that the water resistance of all the ink-jet recording sheets, comprised of the mordants, is markedly improved, and particularly, the ink-jet recording sheets comprising the mordants having a molecular weight of 5000 or more are excellent in the water resistance.

Furthermore, it can be seen that when the mordants having a average molecular weight not exceeding 50,000 are employed, the degradation of the glossiness is small.

Example 2

Ink-jet recording sheets 21 to 27 were prepared in the same manner as in Example 1, except that the polymer mordants were replaced with those shown in Table 2.

Mordants M-1, M-2 and M-3 and M-4 employed here are shown below.

Evaluation was performed in the same manner as in Example 1 and the results shown in Table 2 were obtained.

M-1 (water-soluble mordant)

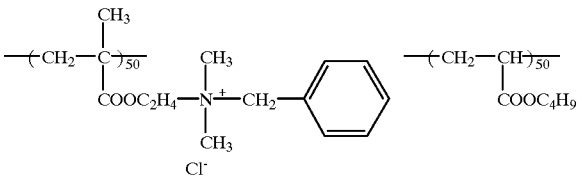

(I/O of monomer = 0.621)

M-2 (water-soluble mordant)

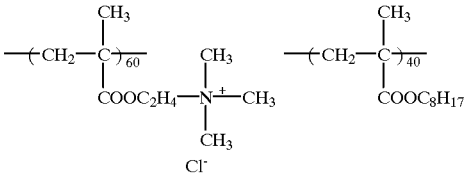

(I/O of monomer = 0.36)

-continued

M-3 (water-soluble mordant)

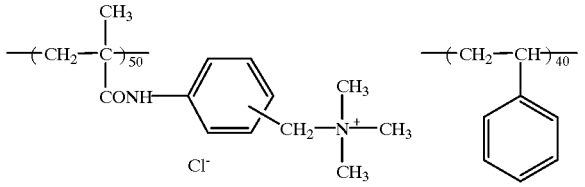

(I/O of monomer = 0.106)

M-4 (latex mordant)

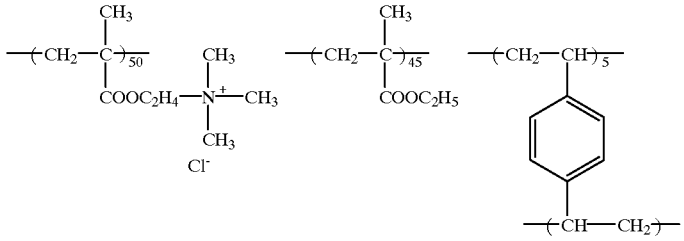

TABLE 2

| Ink-jet Recording Sheet | Mordant Composition | Mordant Average Molecular Weight | Void Volume | Ink Absorbability | Glossiness (%) | Water Resistance (%) | Light Fastness (%) |
|---|---|---|---|---|---|---|---|
| -21 (Present Invention) | M-1 | 20,000 | 23 | 13 | 50 | 96 | 52 |
| -22 (Comparative Example) | M-1 | 70,000 | 22 | 12 | 21 | 97 | 50 |
| -23 (Present Invention) | M-2 | 30,000 | 22 | 11 | 49 | 96 | 50 |
| -24 (Comparative Example) | M-2 | 100,000 | 21 | 12 | 11 | 97 | 49 |
| -25 (Present Invention) | M-3 | 30,000 | 22 | 11 | 51 | 98 | 45 |
| -26 (Comparative Example) | M-3 | 90,000 | 22 | 12 | 17 | 99 | 49 |
| -27 (Comparative Example) | M-4 | — | 24 | 12 | 8 | 98 | 52 |

Based on the results in Table 2, it can be seen that the exchange of the exemplified mordants to water-soluble mordants M-1 to M-3 results in a relatively small decrease in glossiness, if the average molecular weight is 50,000 or less. However, when compared to Example 1, the decrease in glossiness is somewhat greater than the recording sheet in which a particularly preferred exemplified mordant is employed, and the degradation amplitude of the light fastness is also somewhat greater than that of the exemplified mordants.

On the other hand, as compared to the water-soluble mordants, the decrease in glossiness is marked when the latex polymerization mordant M-4 is employed.

Example 3

Ink-jet recording sheets were prepared in the same manner as in Example 1, except that in the ink-jet recording sheet-4 prepared in Example 1, silica was replaced with those as shown in Table 3 and were evaluated in the same manner as in Example 1. Table 3 shows the results.

TABLE 3

| Ink-jet Recording Sheet | Silica: Kind | Silica: Average Particle Diameter (primary particle) (nm) | Void Volume | Ink Absorbability | Glossiness (%) | Water Resistance (%) |
|---|---|---|---|---|---|---|
| -31 (Present Invention) | Colloidal silica | 20 | 15 | 8 | 67 | 98 |
| -32 (Present Invention) | Silica by gas phase method | 12 | 22 | 11 | 54 | 98 |
| -33 (Present Invention) | Silica by gas phase method | 20 | 19 | 12 | 52 | 97 |
| -34 (Comparative Example) | Silica by gas phase method | 50 | 18 | 12 | 15 | 98 |

The results shown in Table 3, indicate that when the colloidal silica prepared by the wet process is employed, the void volume decreases and subsequently the initial ink absorbability also decreases. However, the results also indicate that because the particle diameter is not more than 30 nm, which is in the range of the present invention, excessive glossiness is evident.

Furthermore, with the silica prepared by the gas phase method, when the silica having a particle diameter exceeding 30 nm is employed, the glossiness decreases markedly due to the increase in the particle diameter of the aggregated particles.

The ink-jet recording sheet and ink-jet recording method according to the present invention, exhibit excellent advantages such that excellent water resistance is obtained by adding a cationic mordant to the void-containing layer of the recording sheet comprising a support having thereon the void-containing layer comprising fine inorganic particles as a recording layer, and no decrease in glossiness is accomplished by avoiding aggregate formation between the fine inorganic particles and the cationic polymer.

What is claimed is:

1. An ink-jet recording sheet comprising a support having thereon at least one recording layer wherein the support is a paper support in which both sides are covered with a polyolefin resin, and the recording layer comprises (a) a hydrophilic binder, (b) inorganic fine particles having an average diameter of primary particle of 30 nm or less, (c) a water-soluble cation mordant having an average molecular weight of 50,000 or less and having a repeating unit which has at least one quaternary ammonium base in its molecular structure, and (d) a hardening agent comprising an epoxy group or boric acid which is capable of cross-linking with the hydrophilic binder.

2. The ink-jet recording sheet of claim 1 wherein at least one part of the inorganic fine particles is fine particle silica prepared by a gas phase method.

3. The ink-jet recording sheet of claim 1 wherein the binder is polyvinyl alcohol or its derivative.

4. The ink-jet recording sheet of claim 1, wherein the water-soluble cation mordant is a compound represented by the formula (1), (1)

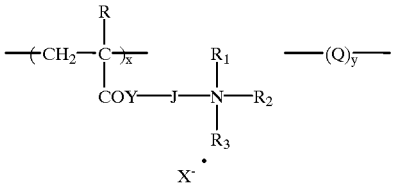

wherein R represents a hydrogen atom or an alkyl group having from 1 to 4 carbon atoms and $R_1$, $R_2$ and $R_3$ each independently represents an alkyl group having from 1 to 4 carbon atoms; Y represents an oxygen atom or a —N($R_4$)— group ($R_4$ represents a hydrogen atom or an alkyl group) and J represents a divalent linking group; $X^-$ represents an anion; Q represents a recurrence unit derived from a monomer having an ethylenic unsaturated group and no cationic group, provided that the value (inorganic/organic) of the monomer constructing Q is not less than 0.5; X is from 30 to 100 mole percent and Y from 0 to 70 mole percent, provided that X+Y=100 mole percent.

5. The ink-jet recording sheet of claim 4, wherein Q is selected from the group consisting of Q-1, Q-2, Q-3, Q-4, Q-5, Q-6, Q-7, Q-8, Q-9, Q-10 and Q-11 as represented below:

Q-1

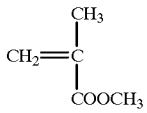

(I/O = 0.87)

Q-2

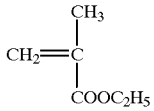

(I/O = 0.725)

-continued
Q-3
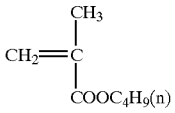
(I/O = 0.544)
Q-4
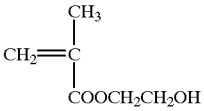
(I/O = 1.558)
Q-5
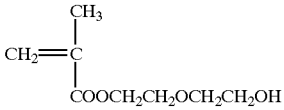
(I/O = 1.294)
Q-6
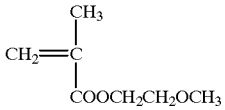
(I/O = 0.764)
Q-7
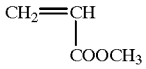
(I/O = 1.088)
-continued
Q-8
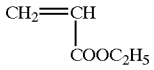
(I/O = 0.87)
Q-9
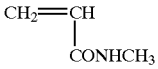
(I/O = 2.525)
Q-10
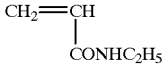
(I/O = 2.02)
Q-11
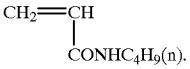
(I/O = 1.44)
6. The ink-jet recording sheet of claim 1, wherein dry thickness of the recording layer is 20 to 50 $\mu$m.
* * * * *